US006250020B1

(12) United States Patent
Shipman

(10) Patent No.: US 6,250,020 B1
(45) Date of Patent: Jun. 26, 2001

(54) PREFABRICATED FURNITURE SYSTEM

(75) Inventor: David A. Shipman, Grand Rapids, MI (US)

(73) Assignee: Steelcase, Inc., Grand Rapids, MI (US)

( * ) Notice: Subject to any disclaimer, the term of this patent is extended or adjusted under 35 U.S.C. 154(b) by 0 days.

(21) Appl. No.: 09/325,482

(22) Filed: Jun. 3, 1999

(51) Int. Cl.[7] ..... A47F 10/00; E04H 1/00

(52) U.S. Cl. ..... 52/36.1; 52/239; 52/586.1; 52/238.1; 52/36.1

(58) Field of Search ..... 52/239, 36.1, 286.1, 52/238.1

(56) References Cited

U.S. PATENT DOCUMENTS

| | | | | |
|---|---|---|---|---|
| 3,378,977 | * | 4/1968 | Vervloet | 52/239 |
| 4,631,881 | * | 12/1986 | Charman | 52/220 |
| 5,675,949 | | 10/1997 | Forslund et al. . | |
| 5,697,193 | | 12/1997 | Forslund, III et al. . | |
| 5,724,778 | | 3/1998 | Cornell et al. . | |
| 5,768,840 | | 6/1998 | Feldpausch et al. . | |
| 5,784,843 | | 7/1998 | Greer et al. . | |
| 5,809,708 | | 9/1998 | Greer et al. . | |
| 6,047,508 | * | 4/2000 | Goodman et al. | 52/238.1 |

OTHER PUBLICATIONS

"Ponté" by Steelcase Strafor (18 pages) dated prior to Jun. 3, 1998.
"Inhaus Q10" by Holzäpfel/Bolte (1 pg.) dated prior to Oct. 1998.
"Work in Progress (W.I.P) Ito Design" by König + Neurath (7 pgs.) dated prior to Oct. 1998.

* cited by examiner

*Primary Examiner*—Carl D. Friedman
*Assistant Examiner*—Chi Nguyen
(74) *Attorney, Agent, or Firm*—Price, Heneveld, Cooper, DeWitt & Litton

(57) ABSTRACT

A prefabricated furniture system including an overhead framework having utility conduits and supporting a plurality of rigid infill panels. The framework extends over the floor of a building space, and has a plurality of posts, and a plurality of beams, at least some of which are supported at a predetermined elevation above an average user height to define an open, three-dimensional gridwork which spatially partitions the associated portion of the building space. The utility conduits extend along the posts and the beams to provide access to utilities throughout the gridwork. The rigid infill panels are shaped for positioning between the beams and the floor of the building in side-by-side juxtaposition. The infill panels include rigid marginal frames, each having a generally rectangular front elevational shape, an interior marginal edge with an interior channel opening toward the interior of the associated one of the frames, and an exterior marginal edge with an exterior channel opening outwardly. A first one of the infill panels includes a rigid center panel mounted in the interior channel of the associated one of the frames to define a framed infill panel. A second one of the infill panels includes at least one flexible cover panel having marginal edges thereof received and retained in the exterior channel of the associated one of the frames, such that the cover panel wraps around the associated frame to define a wrapped infill panel, whereby the framed and wrapped infill panel can be installed at various locations throughout the gridwork.

29 Claims, 7 Drawing Sheets

PREFABRICATED FURNITURE SYSTEM

CROSS-REFERENCE TO RELATED APPLICATIONS

The present application is related to commonly assigned, corresponding U.S. patent applications Ser. No. 09/325,335, filed on even date herewith, entitled PREFABRICATED FURNITURE SYSTEM.

BACKGROUND OF THE INVENTION

The present invention relates to furniture systems for subdividing building space, and more particularly to an integrated furniture system that includes an open framework and a plurality of rigid infill panels supported by the framework for subdividing and outfitting the building space.

Partition systems are well-known in the art for subdividing building space into physically separated work and/or office areas. The partition systems are typically constructed to support individual office-type work activities, and are often adapted for specialized functions, such as carrying utilities, supporting furniture and accessories, providing visual comfort and aesthetics, sound absorption, and the like. Physical separation, privacy, and aesthetics are typically very important to such systems.

Overhead framework systems that are adapted to support activities in open areas, such as for meeting areas and common areas, are also known. Many of these systems include an overhead framework of beams that are supported by posts. The openness of the systems is particularly conducive to group activities, or where conversation and interaction is very important.

Partition systems are also known for subdividing a building space into individual office areas. Some of these partitions are constructed to be rearrangeable. However, rearranging the partition panels within the existing framework is proven to be problematic typically requiring the extensive knowledge of the construction of the system as well as extensive disassembly and reassembly of the system each time the user desires to reconfigure the partition system. Typically, rearranging the panels within the framework cannot be accomplished by the user and requires technical assistance from personnel of the manufacturing or distribution company. These shortcomings are exasperated by situations in which the configuration requirements quickly change.

Another problem typically associated with current partition systems is that changing the color and/or style of the panels associated with the partition system requires the replacement of the entire panel, thereby increasing costs and waste.

Other problems associated with present partition systems include interfacing and interconnecting the panels supported by the framework and the floor in situations where the framework may be uneven due to a non-level floor. In addition, many of these systems do not provide the user with the ability to incorporate partial length panels that do not extend the entire height of the framework. If provided, these partial height panels are typically difficult to adjust, manipulate, and rearrange, similar to as described above.

Accordingly, an integrated furniture system is desired solving the aforementioned problems, and yet which maintains the advantages of systems adapted for separate use and for rearrangement.

SUMMARY OF THE INVENTION

One aspect of the present invention, a prefabricated furniture system for interior building space and the like of the type having a floor and an open plan, which includes an overhead framework having utility conduits and that are adapted for supporting a plurality of rigid infill panels. The overhead framework extends over the floor of the building space, and includes a plurality of posts, and a plurality of beams, at least some of which are supported at a predetermined elevation above an average user height to define an open, three-dimensional gridwork that spatially partitions the associated portion of the building space. The utility conduits extend along the posts and the beams to provide access to utilities throughout the gridwork. The rigid infill panels are shaped for positioning between the beams and the floor of the building in side-by-side juxtaposition. The infill panels include rigid marginal frames, each having a generally rectangular front elevational shape, an interior marginal edge with an interior channel opening toward the interior of the associated one of the frames, and an exterior marginal edge with an exterior channel opening outwardly. A first one of the infill panels includes a rigid center panel mounted in the interior channel of the associated one of the frames to define a framed infill panel. A second one of the infill panels includes at least one flexible cover panel having marginal edges thereof received and retained in the exterior channel of the associated one of the frames, such that the cover panel wraps around the associated frame to define a wrapped infill panel. The framed and wrapped infill panel can be installed at various locations throughout the gridwork to create workstations with visual privacy and utility access, and can be rearranged to accommodate different work requirements and create different aesthetics.

In another aspect of the present invention, an infill panel kit for prefabricated furniture systems and the like includes a plurality of rigid marginal frames, each having a generally rectangular front elevational shape, an interior marginal edge with an interior channel opening toward the interior of the associated one of the frames, and an exterior marginal edge with an exterior channel opening outwardly. The infill panel kit further includes at least one rigid center panel adapted to be mounted to the interior channel of the associated one of the frames to define a framed infill panel. The infill panel kit still further includes at least one flexible cover panel having marginal edges thereof received and retained in the exterior channel of an associated one of the frames, such that the cover panel wraps around the associated frame to define a wrapped infill panel.

Yet another aspect of the present invention is to provide a prefabricated furniture system for interior building space and the like of the type having a floor with an open plan including an overhead framework having utility conduits and that is adapted for supporting a plurality of rigid infill panels. The overhead framework extends over the floor of the building space, and includes a plurality of posts, and a plurality of beams supported at a predetermined elevation to define an open, three-dimensional gridwork which spatially partitions the associated portion of the building space. The utility conduits extend along the posts and the beams to provide access to utilities throughout the gridwork. The plurality of rigid infill panels are shaped for positioning between the beams. The infill panels include rigid marginal frames, each having a generally rectangular front elevational shape, an interior marginal edge with an interior channel opening toward the interior of the associated one of the frames, and an exterior marginal edge with an exterior channel opening outwardly. A first one of the infill panels includes a rigid center panel mounted in the interior channel of the associated one of the frames to define a framed infill panel. A second one of the infill panels includes at least one flexible cover panel having marginal edges thereof received and retained in the exterior channel of the associated one of the frames, such that the cover panel wraps around the associated frame to define a wrapped infill panel, and whereby the framed and wrapped infill panel can be installed at various locations throughout the gridwork to create visual privacy.

Still yet another aspect of the present invention is to provide a method for making infill panels for space partition systems and the like of the type having a framework extending over the floor of the building space, with a plurality of posts, and a plurality of beams supported at a predetermined elevation to define an open, three-dimensional gridwork which spatially partitions the associated portion of the building space. The method includes providing a plurality of rigid marginal frames, each having a generally rectangular front elevational shape, an interior marginal edge with an interior channel opening toward the interior of the associated one of the frames, and an exterior marginal edge with an exterior channel opening outwardly. The method further includes mounting a rigid center panel in the interior channel of a first one of the frames to define a framed infill panel. The method still further includes, mounting a flexible cover panel having marginal edges thereof received and retained in the exterior channel of the second one of the frames, such that the cover panel wraps around the associated frame to define a wrapped infill panel whereby the framed and wrapped infill panel can be installed at various locations throughout the gridwork to create workstations and visual privacy, and can be reconfigured to create different aesthetics.

These and other aspects, objects, and advantages of the present invention will be understood and appreciated by those skilled in the art by reference to the present specification, claims, and appended drawings.

DETAILED DESCRIPTION OF PREFERRED EMBODIMENT

Figure 1:
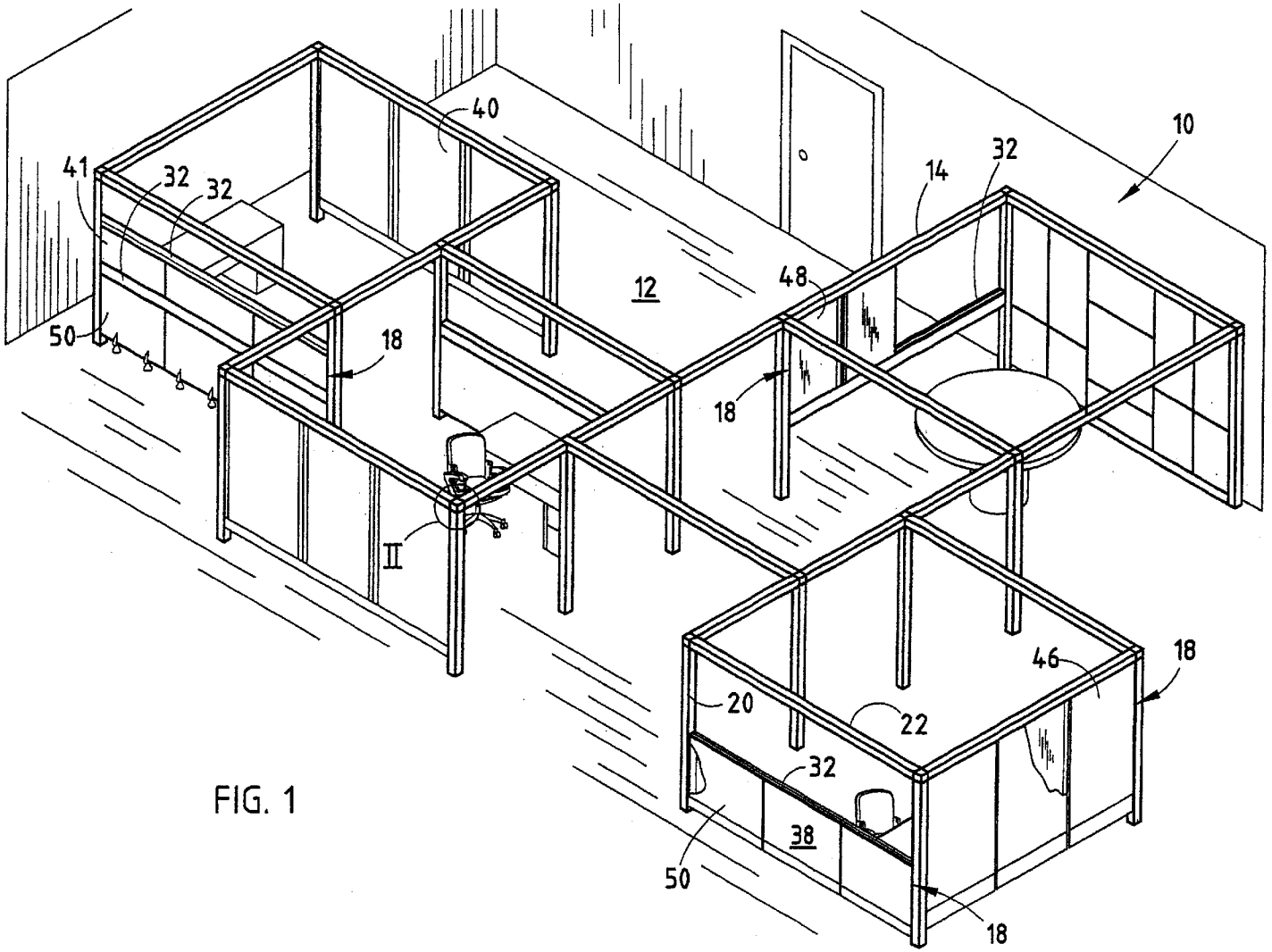
FIG. 1 is a perspective view of a prefabricated furniture system.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
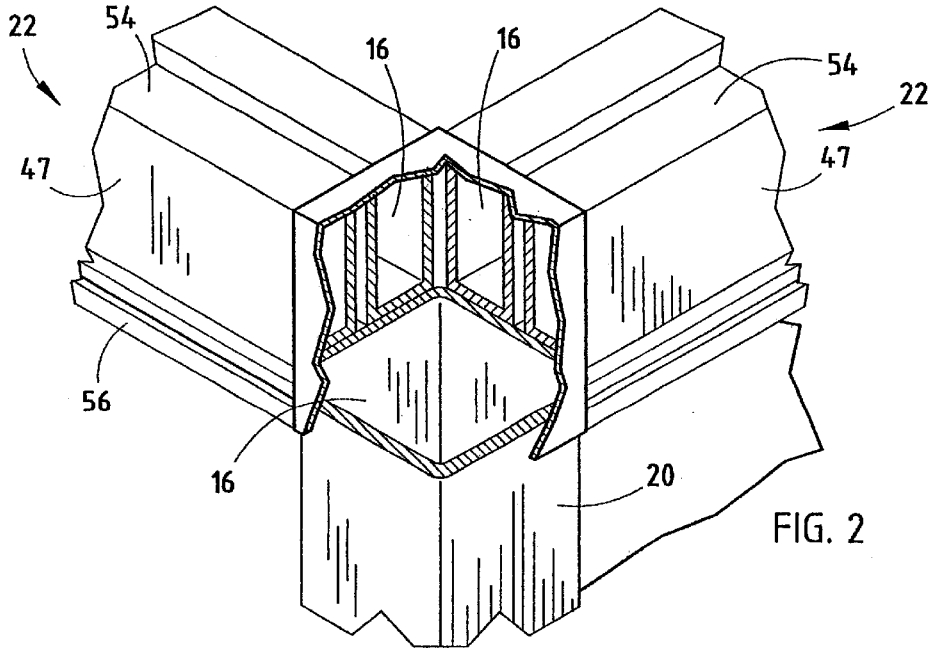
FIG. 2 is an enlarged, fragmentary perspective view of a three-dimensional frame of the furniture system, shown of area II, FIG. 1.
Figure 3:
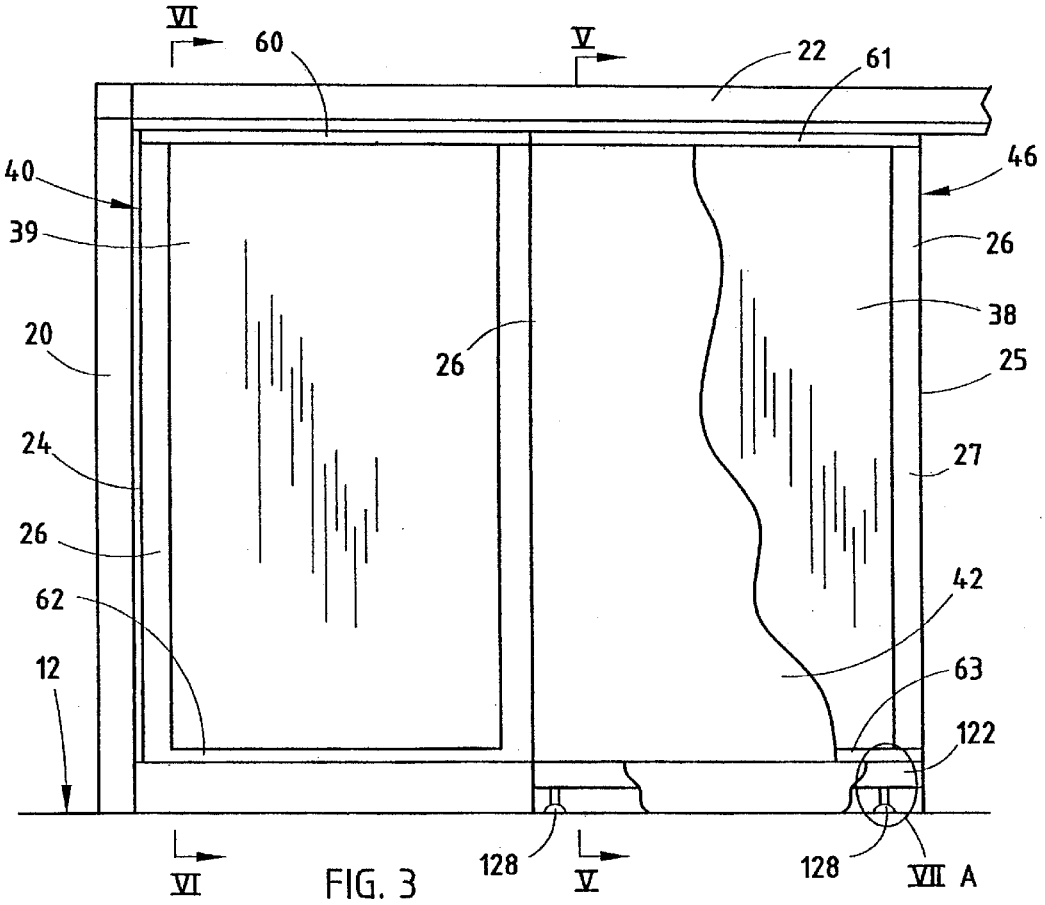
FIG. 3 is a front elevational view of a full-length framed panel, and a full-length covered panel.
Figure 4A:
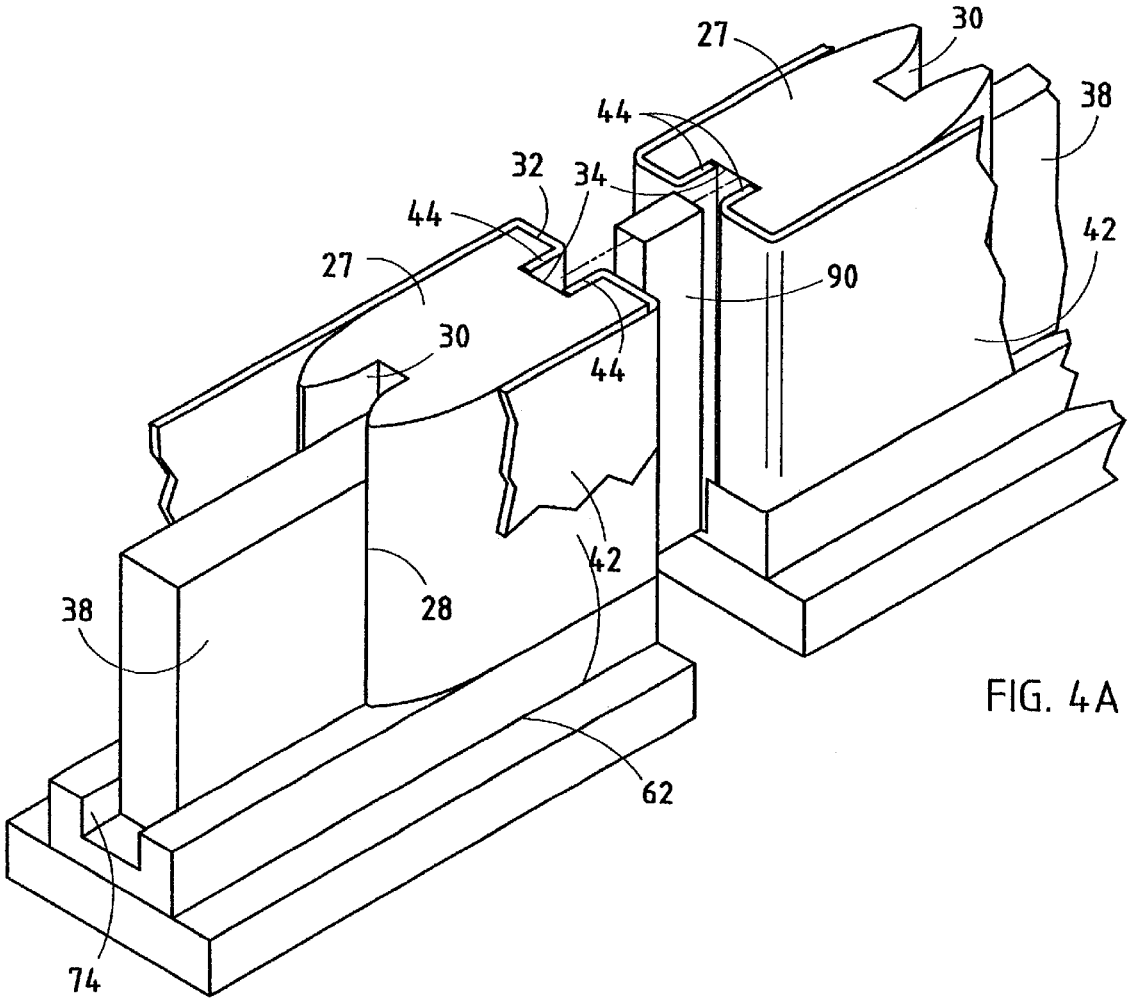
FIG. 4 is an exploded, cross-sectional, fragmentary perspective view of the covered panel in splined connection with a second covered panel, each covered panel housing a thin center panel.
Figure 4B:
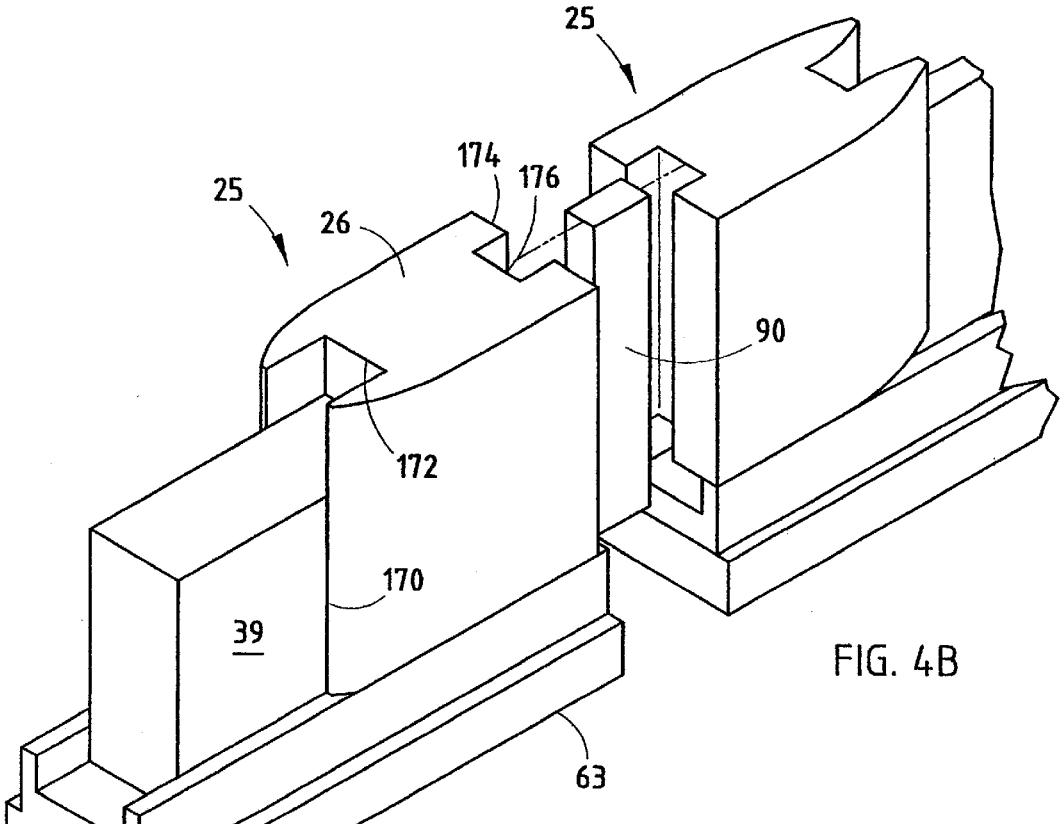

The reference numeral 10 (FIG. 1) generally designates a prefabricated furniture system for interior building space and the like of the type having a floor 12 with an open plan. furniture system 10 includes an overhead framework 14 having utility conduits 16 (FIG. 2), and that is adapted for supporting a plurality of rigid infill panels 18 that can be provided in a plurality of shapes, sizes and widths. The overhead framework 14 extends over the floor 12 of the building space, and includes a plurality of posts 20, and a plurality of beams 22, at least some of which are supported at a predetermined elevation above an average user height to define an open, three-dimensional gridwork that spatially partitions the associated portion of the building space. The utility conduits 16 extend along the posts 20 and the beams 22 to provide access to utilities throughout the framework 14. The rigid infill panels 18 are shaped for positioning between beams 22 and floor 12 of the building in side-by-side juxtaposition. The infill panels 18 include rigid marginal frames 24 (FIG. 3), each having a generally rectangular front elevational shape. Frames 24 are each provided side frame members 26 (FIG. 4) having an interior marginal edge 28 with an interior channel 30 opening toward the interior of the associated one of the frames 24, and an exterior marginal edge 32 with an exterior channel 34 opening outwardly. A first one of the infill panels 18 includes a rigid center panel 38 mounted in the interior channel 30 of the associated one of the frames 24 to define a framed infill panel 40 (FIG. 3). A second one of the infill panels 18 includes a rigid center panel 39 and at least one flexible cover panel 42 having marginal edges 44 thereof received and retained in the exterior channel 34 of the associated one of the frames 24, such that the cover panel 42 wraps around the associated frame 24 to define a wrapped infill panel 46. Framed infill panels 40 and wrapped infill panels 46 can be installed at various locations throughout the gridwork to create workstations with visual privacy and utility access, and can be rearranged to accommodate different work requirements and create different aesthetics.

The illustrated framework 14 (FIG. 1) can be arranged and constructed to subdivide a wide variety of room dimensions and to satisfy numerous spatial orientations and subdivisional requirements. The basic framework 14 includes posts 20 and beams 22 connected at an uppermost portion of posts 20. A plurality of intermediate beams 32 extending between associated posts 20 may be placed in numerous locations between floor 12 and the uppermost beams 22 that are connected to the top of posts 20. By utilizing intermediate beams 32, framework 14 can be adapted to support a variety of sizes of shapes of panels 18, including full-length or full-height infill panels 40 and 46 extending nearly the full distance between beams 22 and floor 12, partial length or partial height upper panels 48 extending between intermediate beams 32 and beams 22, partial length or partial height lower panels 50 extending between floor 12 and intermediate beams 32, and partial length or partial height intermediate panels 41 extending between intermediate beams 32.

Figure 5:
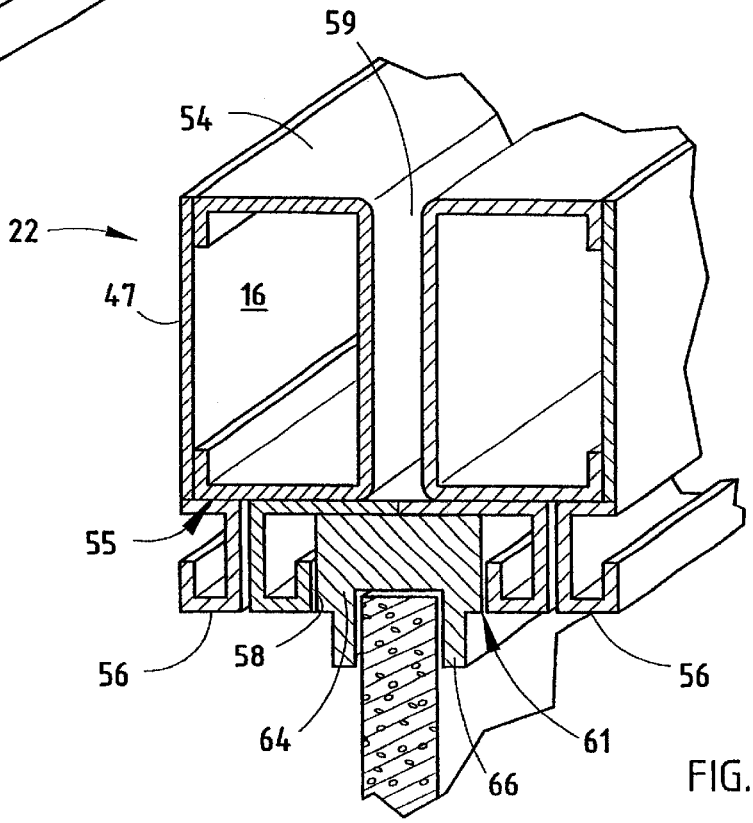
FIG. 5 is a fragmentary, cross-sectional perspective view of a beam and the thin center panel, taken along the line V—V, FIG. 3.

Each beam 22 (FIGS. 2 and 5) includes a pair of C-shaped, outwardly opening upper channels 54 that house utility conduits 16 therein, have lower walls 55, and define a center channel 59 therebetween. Each beam 22 further includes a pair of C-shaped hanging channels 56 downwardly extending from lower walls 55, and a centrally located, downwardly opening C-shaped center channel 58. Each channel 54 of beam 22 is covered with a face plate 47 that is attached thereto by way of fasteners (not shown) such as screws or the like.

The illustrated intermediate beams 32 (FIG. 9) are similar in configuration to beams 22. Intermediate beams 32 each include a pair of C-shaped, outwardly opening upper channels 150 that house utility conduits 16 therein, have lower walls 152, and define an upper channel 153 therebetween. Each intermediate beam 32 further includes a centrally located, downwardly opening C-shaped center channel 156. Each channel 150 of intermediate beam 32 is covered with a face plate 158 that is attached thereto by way of fasteners (not shown) such as screws and the like.

Utility conduits 16 extend along posts 20, beams 22, and intermediate beams 32, and provide access to utilities throughout the framework 14. The utilities can include power lines for supporting electronic equipment as well as telephone lines, telecommunication lines, and computer network wiring, thereby allowing hidden, yet easy accessible routing throughout framework 14.

Framed infill panel 40 (FIG. 3) and wrapped infill panel 46 are each provided with frame 24 and 25, respectively, and thin rigid center panel 38 or thick rigid center panel 39, depending upon the requirements of the application. The rigid center panels of any panel 18 can be provided in a plurality of widths depending upon the requirements of the application, however, are preferably provided as thin rigid center panel 38 having a thickness of approximately 1 inch, and thick rigid center panel 39 having a thickness of approximately 2 inches.

The illustrated rigid center panels 38 and 39 are constructed of a rigid material such as wood, plastic, glass, or fiberboard, including fiberglass and cardboard, however, any suitable material may be used. More particularly, rigid panels 38 and 39 can be constructed of opaque, translucent or transparent materials. In addition, the materials use may be coated with a pattern or perforations for aesthetic reasons. Each framed infill panel 40 includes frame 24 that extends about the outside of panel 40 and has side frame members 26, an upper frame member 60, and a lower frame member 62. Each wrapped infill panel 46 includes a frame 25 that extends about the outsides of panel 46 and has side frame members 27, an upper frame member 61, and a lower frame member 63.

Side frame members 27 (FIG. 4) of frames 25 are each provided with interior marginal edge 28 with interior channel 30 opening toward the interior of the associated frame 24, and adapted to secure rigid center panel 38 therein and exterior marginal edge 32 with exterior channel 34 opening outwardly. Side frame members 27 are accurately shaped to form a bull-nosed shaped cross-section. Upper frame member 61 (FIG. 5) is adapted to receive and support thin rigid center panel 38, is provided a substantially T-shape, and includes a horizontally disposed upper guide portion 64 that is configured to rest within center channel 58 of beam 22 and a pair of downwardly extending arms 66 adapted to secure thin rigid center panel 38 therebetween. Lower frame member 62 is substantially similar to upper frame member 60.

Figure 6:
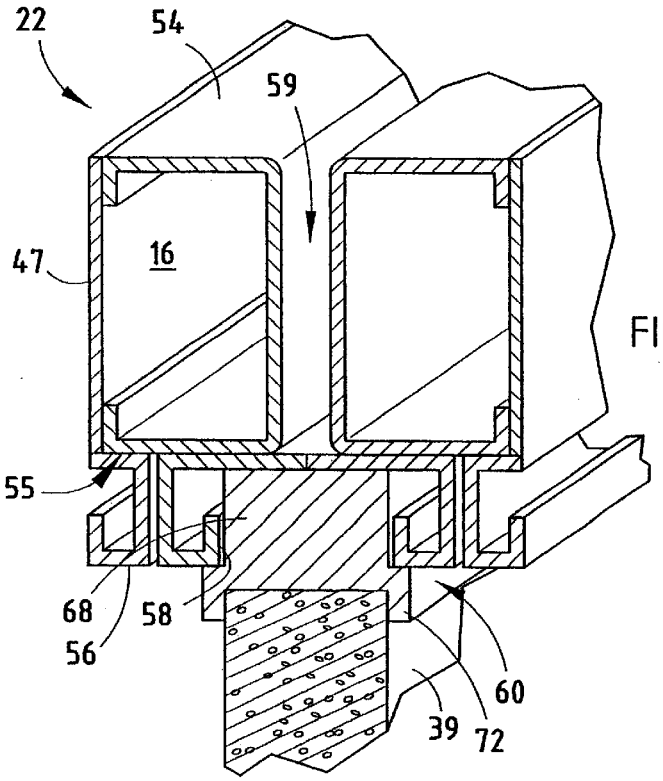
FIG. 6 is a fragmentary, cross-sectional perspective view of the beam and a thick center panel, taken along the line VI—VI, FIG. 3.

Side frame members 26 of frames 24 are each provided with interior marginal edge 170 with interior channel 172 opening toward the interior of associated frame adapted to secure rigid center panel 39 therein and exterior marginal edge 174 with exterior channel opening outwardly. Side frame members 26 are arcuately shaped to form a bull-nosed shape cross-section. Upper frame member 60 (FIG. 6) is adapted to receive and support thick rigid center panel 39 which is provided with a greater thickness than thin rigid center panel 38 previously described. Upper frame member 60 is substantially Y-shaped having an upwardly extending guide portion 68 adapted to be received within center channel 58 of beam 22 and a pair of downwardly extending arms 72 adapted to secure thick rigid center panel 39 therebetween. Lower frame member 62 (FIG. 3) is substantially similar to upper frame member 60.

The illustrated wrapped infill panels 46 are further provided with flexible cover 42 (FIG. 4) that wraps about the exterior of side frame members 27 of frame 25 and marginal edges 44. Cover 42 can be constructed of cloth or a synthetic material and may be provided in numerous colors, patterns, or textures. In assembly, cover 42 wraps about frame 25 such that marginal edges 44 are received and retained within exterior channels 34 of side frame members 26. An elongated spline or retainer key 90 having a rectangular cross-sectional shape that is engaged within exterior channel 34 of side frame members 26, thereby retaining marginal edges 44 of cover 42 therein.

Figure 7B:
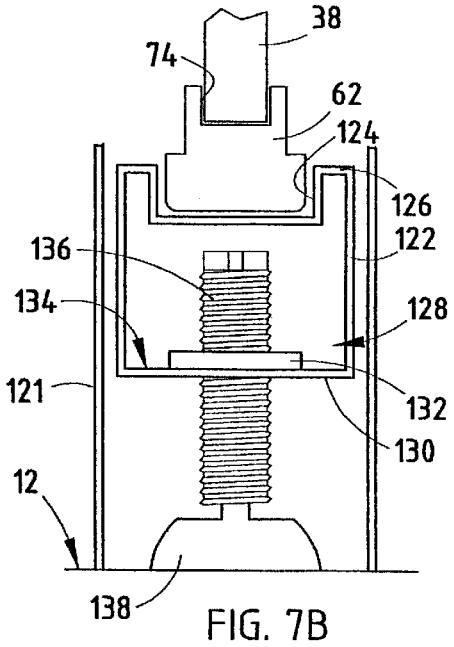
FIG. 7B is an enlarged side view of the leveler.
Figure 7A:
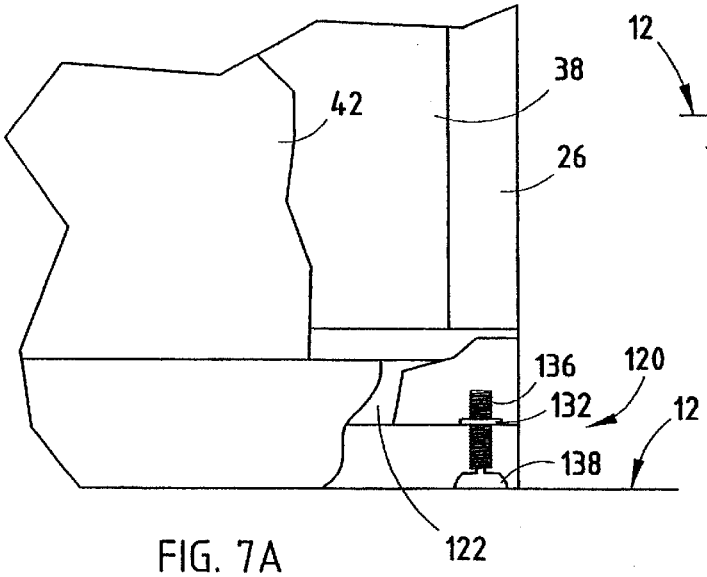
FIG. 7A is a fragmentary, front elevational view of the covered panel supported by a leveler, shown of area VIIA, FIG. 3.

The illustrated framed infill panels 40 and wrapped infill panels 46 are supported above floor 12 by a leveler 120 (FIGS. 7A and 7B). Leveler 120 includes a floor beam 122 having an upwardly opened C-shaped channel 124 disposed in an upper wall 126 of floor beam 122, and adjustable feet 128 threadably engaged within a lower wall 130 of floor beam 122. Channel 124 of floor beam 122 is adapted to receive lower frame members 62 and 63 therein. Each foot 128 includes a threaded nut 132 welded to an interior surface 134 of lower wall 130 of floor beam 122, and a threaded member 136 threadably engaged with nut 132. Each foot 132 is further provided with a support member 138 that is pivotably attached to an end of threaded member 136 and is adapted to engage floor 12. The effective length or height of each infill panel 40 and 46 can be adjusted by threading the threadable member 136 into and out of nut 132, thereby adjusting the effective distance the threaded member 135 extends below lower wall 130 of floor beam 122. The adjustablility of leveler 120 allows the installer to adjust the length of the infill panel 40 or 46, such that the furniture system 10 can be used in applications where floor 12 may be uneven. Leveler 120 also includes a pair of face plates 121 attached to floor beam 122 by way of mechanical fasteners (not shown) such as screws or the like.

In assembly with framework 14, infill panels 40 and 46 are maneuvered into place such that upper frame member 60 or upper frame member 61, depending upon the requirements of the application and whether the thin rigid center panel 38 or thick rigid center panel 39 is selected, is positioned below center channel 58 of beam 22. The height (or effective length) of the panel is then adjusted by way of levelers 120 until the upper frame member 60 or 61 is engaged within center channel 58 of beam 22. Side-by-side juxtaposition panels, whether they be framed infill panels 40 or wrapped infill panels 46, may be joined and interlaced by way of spline 90 located within exterior channels 34 of side frame members 26 of each infill panel 40 or 46.

Figure 8:
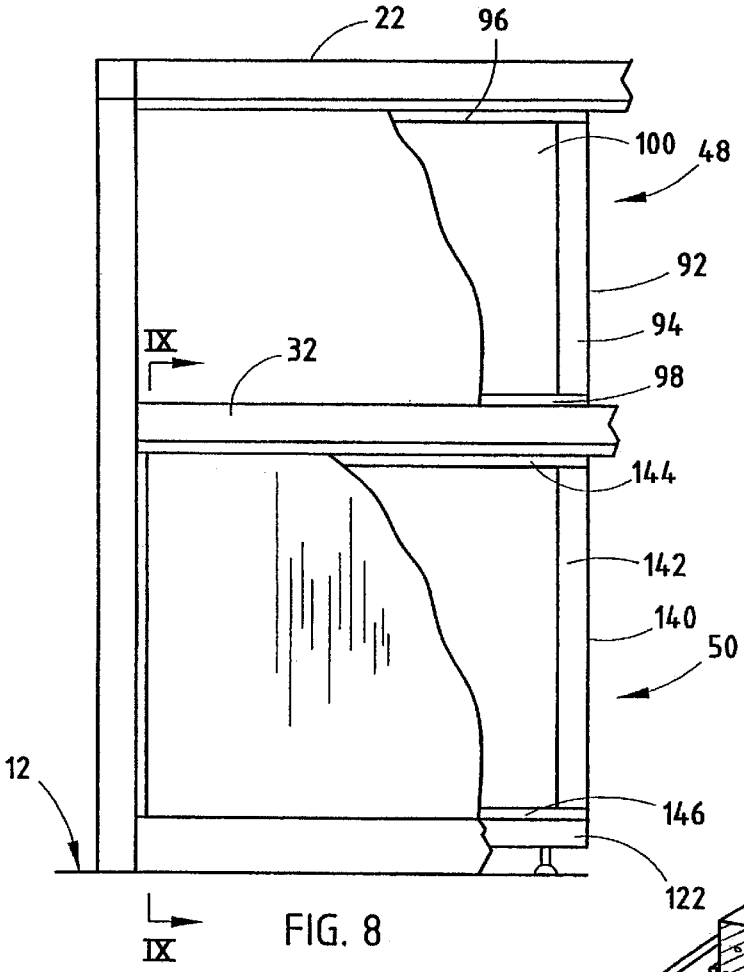
FIG. 8 is a front elevational view of a partial length upper panel extending between an intermediate beam and an upper beam, and a partial length lower panel extending between the intermediate beam and an upper beam.

As shown in FIG. 8, partial length upper panels 48 extend between intermediate beams 32 and beams 22. Upper panels 48 can be provided in any length (or height) corresponding to the distance between intermediate beams 32 and beams 22 as intermediate beams 32 may be attached anywhere along the height of posts 20. Upper panels 48 are each provided with a frame 92 extending thereabout that include side frame members 94, top frame members 96, and bottom frame members 98, that are each similar in construction and configuration to side members 26, top frame members 61, and bottom frame members 63 of frames 25 of infill panels 46. Alternatively, frames 92 of upper panels 48 can be constructed similar to frame 24 to support thick rigid infill panels 39. In assembly, upper panels 48 are slid into position between intermediate beams 32 and beams 22 as intermediate beams 32 are attached to framework 14.

Figure 9:
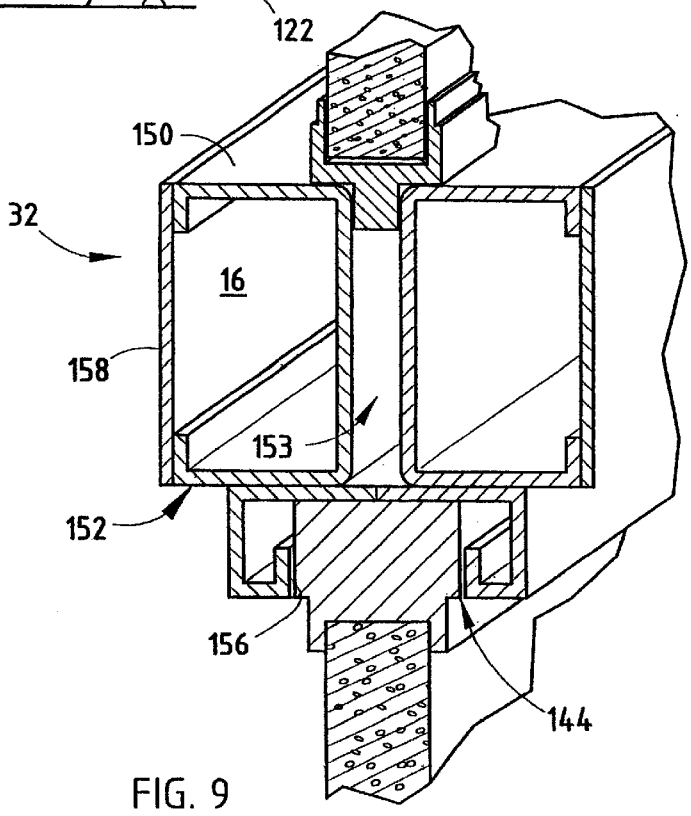
FIG. 9 is a fragmentary, cross-sectional perspective view of the intermediate beam supporting the upper and lower panels, taken along line IX-IX, FIG. 8.

As illustrated, partial length lower panels 50 extend between intermediate beams 32 and floor 12. Lower panels 50 can be provided in any length (or height) corresponding to the distance between intermediate beams 32 and floor 12. Lower panels 50 are each provided with a frames 140 that extend thereabout and include side frame members 142, top frame members 144, and bottom frame members 146, that are similar in construction and configuration to side frame members 26, top frame members 61, and bottom frame members 63 of frames 25 of panels 46. Alternatively, frames 140 of lower panels 50 can be constructed similar to frame 24 to support thick rigid infill panels 39. In assembly, bottom frame member 146 is placed within channel 124 of floor beam 122, and lower panel 50 is positioned below intermediate beam 32 such that it is vertically oriented. Feet 128 are then adjusted until the effective overall length (or height) of lower panel 50 retains top frame member 144 within channel 156 of intermediate beam 32 (FIG. 9).

Figure 10:
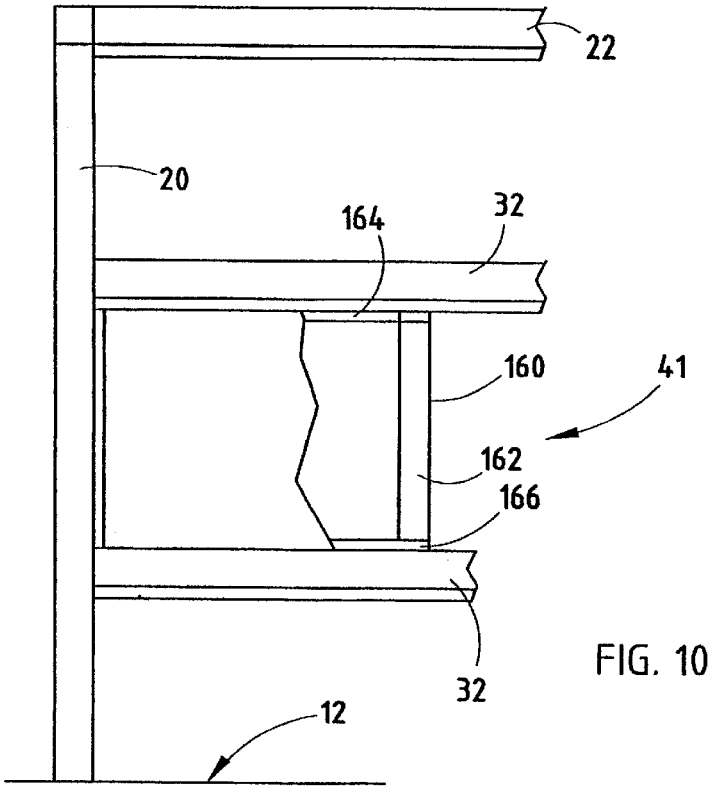
FIG. 10 is a front elevational view of a partial length intermediate panel extending between intermediate beams.

As shown in the illustrated example, intermediate panels 41 (FIG. 10) extend between intermediate beams 32, and can be provided in any length (or height) corresponding to the distance between intermediate beams 32. Intermediate panels 41 are each provided with a frame 160 extending thereabout that includes side frame members 162, top frame members 164, and bottom frame members 166, that are similar in construction and configuration to side frame members 26, top frame members 61, and bottom frame members 63 of frames 25, respectively. Alternatively, frames 160 of intermediate panels 41 can be constructed similar to frame 24 to support thick rigid infill panels 39. In assembly, intermediate panels 41 are slid into position between intermediate beams 32 when intermediate beams 32 are attached to framework 14.

Figure 11:
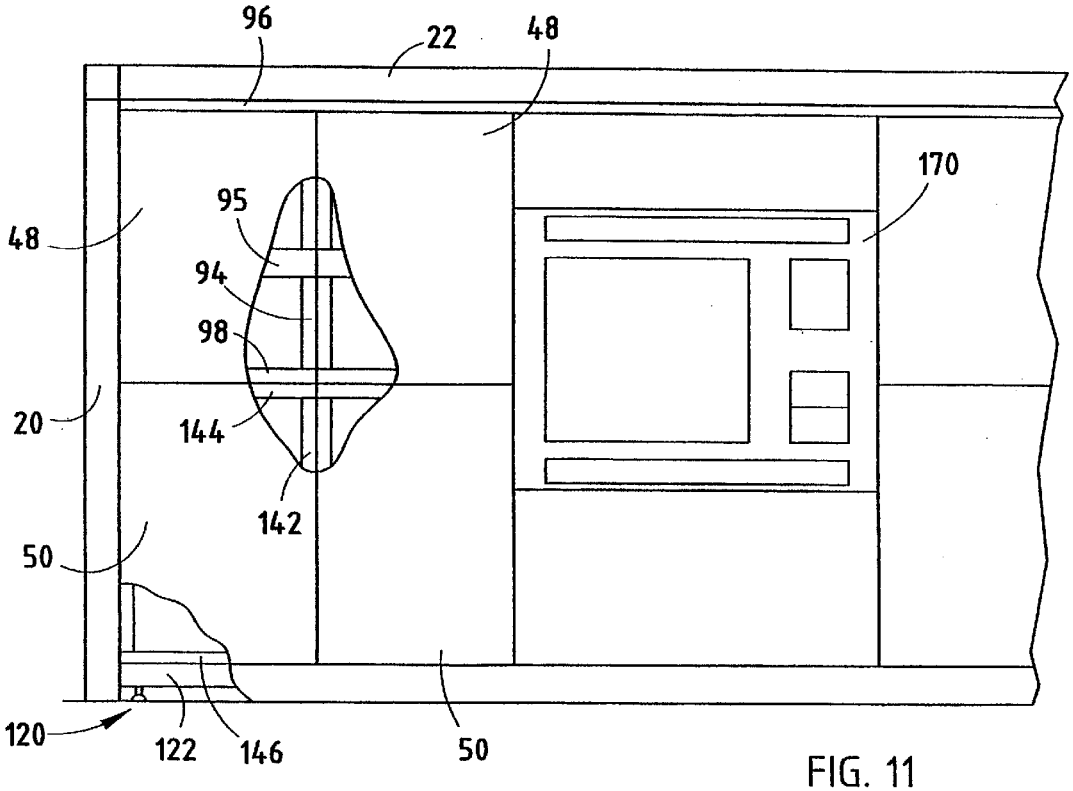
FIG. 11 is a front elevational view of a plurality of partial length panels interconnected within the frame.

Upper panels 48 (FIG. 11) and lower panels 50 can be interlaced and fit within framework 14 without the use of intermediate beams 32 to create areas easily adaptable for handling awkwardly shaped in-wall applications such as television monitors and telecommunication centers 170. In assembly, lower panels 50 are supported and adjusted for length (or height) by levelers 120. Lower panels 50 are positioned in side-by-side juxtaposition and are connected to one another by way of splines 90 (FIG. 4) that extend between and connect side frame members 142. Upper panels 48 are also positioned in side-byside juxtaposition and are also connected to one another by splines 90 extending between and connecting side frame members 94. Bottom frame members 98 of upper panels 48 and top 14 frame members 144 of lower panels 50 can be connected together by way of mechanical fasteners or adhesives, however, it is preferred that bottom frame members 98 of upper panels 48 are held in place on top of top frame members 144 of lower panels 50 by tension created between levelers 120 and top frame members 96 of upper panels 48 against beams 22. Upper panels 48 and/or lower panels 50 may also be provided with intermediate frame members, thereby adding structural rigidity thereto. In this fashion, furniture system 10 can be quickly and conveniently adapted to house and frame awkwardly shaped units and displays therein.

The present invention furniture system 10 is easily rearrangable without requiring extensive knowledge of the construction of the furniture system 10. In addition, rearrangement and reconfiguration of furniture system 10 can be done quickly, thereby lending itself to use in environments having rapidly changing requirements.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A prefabricated furniture system for interior building space of the type having a floor with an open plan, comprising:

an overhead framework extending over the floor of the building space, and including a plurality of posts, and a plurality of beams, at least some of which are supported at a predetermined elevation above average user height to define an open, three-dimensional gridwork which spatially partitions the associated portion of the building space;

utility conduits extending along said posts and said beams to provide access to utilities throughout said gridwork;

a plurality of rigid infill panels, shaped for positioning between said beams and the floor of the building in side-by-side juxtaposition; said infill panels including rigid marginal frames, each having a generally rectangular front elevational shape, an interior marginal edge with an interior channel opening toward the interior of the associated one of said frames, and an exterior marginal edge with an exterior channel opening outwardly; and wherein a first one of said infill panels includes a rigid center panel mounted in the interior channel of the associated one of said frames to define a framed infill panel; and a second one of said infill panels includes at least one flexible cover panel having marginal edges thereof received and retained in the exterior channel of the associated one of said frames, such that said cover panel wraps around the associated frame to define a wrapped infill panel, whereby said framed and wrapped infill panel can be installed at various locations throughout said gridwork to create workstations with visual privacy and utility access, and can be rearranged to accommodate different work requirements and create different aesthetics.

2. A furniture system as set forth in claim 1, including:

a plurality of connector keys shaped for close reception in the exterior channel of said frames, and extending between laterally adjacent ones of said frames to align and interconnect the same.

3. A furniture system as set forth in claim 2, wherein:

said frames each include opposite faces; and said wrapped infill panel includes one said cover panel on both of said faces of the associated frame.

4. A furniture system as set forth in claim 3, including:

a plurality of retainer keys shaped for close reception in the exterior channel of said frames, and retaining each said cover panel therein.

5. A furniture system as set forth in claim 4, wherein:

said beams include downwardly opening channels shaped to receive and retain therein upper portions of said infill panels.

6. A furniture system as set forth in claim 5, wherein:

each said frame includes a top frame member, a bottom frame member, and a pair of opposite side frame members which are rigidly interconnected.

7. A furniture system as set forth in claim 6, wherein:

said side frame members have a curvilinear cross-sectional shape and taper inwardly toward said interior marginal edge; and said exterior marginal edge of said frames is generally flat and oriented substantially perpendicular to said faces, such that said lateral cross-sectional shape defines a bull nose configuration.

8. A furniture system as set forth in claim 7, wherein:

said infill panels are shaped for positioning side-by-side with adjacent ones of said exterior marginal edges in abutment.

9. A furniture system as set forth in claim 8, wherein:

said connector keys comprise elongate bars having a generally rectangular lateral cross-sectional shape with opposite sides thereof closely received in adjacent ones of said exterior channels.

10. A furniture system as set forth in claim 9, wherein:

each said cover panel is constructed from a fabric material.

11. A furniture system as set forth in claim 10, wherein:

said center panel is constructed from a transparent material.

12. A furniture system as set forth in claim 10, wherein:

said center panel is constructed from a perforated panel.

13. A furniture system as set forth in claim 1, wherein:

said frames each include opposite faces; and said wrapped infill panel includes one said cover panel on both of said faces of the associated frame.

14. A furniture system as set forth in claim 1, including:

a plurality of retainer keys shaped for close reception in the exterior channel of said frames, and retaining each said cover panel therein.

15. A furniture system as set forth in claim 14, wherein:

said connector keys comprise elongate bars having a generally rectangular lateral cross-sectional shape with opposite sides thereof closely received in adjacent ones of said exterior channels.

16. A furniture system as set forth in claim 1, wherein:

said beams include downwardly opening channels shaped to receive and retain therein upper portions of said infill panels.

17. A furniture system as set forth in claim 1, wherein:

each said frame includes a top frame member, a bottom frame member, and a pair of opposite side frame members which are rigidly interconnected, and have a substantially similar lateral cross-sectional shape.

18. A furniture system as set forth in claim 17, wherein:

said side frame members have an arcuately shape cross-section and taper inwardly toward said interior marginal edge; and said exterior marginal edge of said frames is generally flat and oriented perpendicular to said faces, such that said lateral cross-sectional shape defines a bull nose configuration.

19. A furniture system as set forth in claim 1, wherein:

said infill panels are shaped for positioning side-by-side with adjacent ones of said exterior marginal edges in abutment.

20. A prefabricated furniture system for interior building space of the type having a floor with an open plan, comprising:

a framework extending over the floor of the building space, and including a plurality of posts, and a plurality of beams supported at a predetermined elevation to define an open, three-dimensional gridwork which spatially partitions the associated portion of the building space;

utility conduits extending along said posts and said beams to provide access to utilities throughout said gridwork; and a plurality of rigid infill panels shaped for positioning between said beams; said infill panels including rigid marginal frames, each having a generally rectangular front elevational shape, an interior marginal edge with an interior channel opening toward the interior of the associated one of said frames, and an exterior marginal edge with an exterior channel opening outwardly; and wherein a first one of said infill panels includes a rigid center panel mounted in the interior channel of the associated one of said frames to define a framed infill panel; and a second one of said infill panels includes at least one flexible cover panel having marginal edges thereof received and retained in the exterior channel of the associated one of said frames, such that said cover panel wraps around the associated frame to define a wrapped infill panel, whereby said framed and wrapped infill panel can be installed at various locations throughout said gridwork to create visual privacy.

21. A prefabricated furniture system as set forth in claim 20, wherein:

at least one of said beams is disposed overhead and defines an overhead beam;

at least one of said beams is disposed between the floor and said overhead beam and defines an intermediate beam; and at least one of said infill panels is shaped to fit between said overhead beam and said intermediate beam.

22. A prefabricated furniture system as set forth in claim 21, including:

a plurality of said intermediate beams disposed in a generally horizontal orientation at various heights; and at least one of said infill panels is shaped to fit between two vertically adjacent intermediate beams.

23. A prefabricated furniture system as set forth in claim 22, wherein:

at least one of said infill panels is shaped to fit between the floor and said intermediate beam.

24. A prefabricated furniture system as set forth in claim 23, wherein:

at least one of said infill panels is shaped to fit between the floor and said overhead beam.

25. A prefabricated furniture system as set forth in claim 24, wherein:

said intermediate beams include a downwardly opening channel extending along the lower wall thereof and an upwardly opening channel extending along an upper wall thereof; said upper and lower channels being similarly shaped, and adapted to receive therein a portion of one of said infill panels.

26. A method for making infill panels for space partition systems and the like of the type having:

a framework extending over the floor of the building space, with a plurality of posts, and a plurality of beams supported at a predetermined elevation to define an open, three-dimensional gridwork which spatially partitions the associated portion of the building space;

providing a plurality rigid marginal frames, each having a generally rectangular front elevational shape, an interior marginal edge with an interior channel opening toward the interior of the associated one of said frames, and an exterior marginal edge with an exterior channel opening outwardly;

mounting a rigid center panel in the interior channel of a first one of said frames to define a framed infill panel; and mounting a flexible cover panel having marginal edges thereof received and retained in the exterior channel of a second one of said frames, such that the cover panel wraps around the associated frame to define a wrapped infill panel whereby the framed and wrapped infill panel can be installed at various locations throughout the gridwork to create workstations and visual privacy, and can be reconfigured to create different aesthetics.

27. A method as set forth in claim 26, including:

inserting connector keys in the exterior channel of the frames, so as to extend between laterally adjacent ones of the frames to align and interconnect the same.

28. A method as set forth in claim 27 wherein:

said flexible cover mounting step includes wrapping one of the flexible cover panels on both of the faces of the frames.

29. A method as set forth in claim 28, including:

inserting retainer keys in the exterior channel of the frames to retain each of the cover panels therein.

* * * * *

UNITED STATES PATENT AND TRADEMARK OFFICE

CERTIFICATE OF CORRECTION

PATENT NO. : 6,250,020 B1
DATED : June 26, 2001
INVENTOR(S) : David A. Shipman

It is certified that error appears in the above-identified patent and that said Letters Patent is hereby corrected as shown below:

Column 1,
Line 43, "exasperated" should be -- exacerbated --.

Column 4,
Line 27, "furniture" should be -- Furniture --.

Column 5,
Line 56, "use" should be -- used --.

Column 6,
Line 3, "accurately" should be -- arcuately --.

Column 7,
Line 30, delete "a".

Column 8,
Line 5, after "top" delete "14".

Column 10,
Line 4, "shape" should be -- shaped --.

Signed and Sealed this

Twenty-seventh Day of August, 2002

*Attest:*

*Attesting Officer*

JAMES E. ROGAN
*Director of the United States Patent and Trademark Office*